US009422835B2

(12) United States Patent
Ikeda

(10) Patent No.: US 9,422,835 B2
(45) Date of Patent: Aug. 23, 2016

(54) VALVE TRAIN SYSTEM DRIVE DEVICE FOR AN INTERNAL COMBUSTION ENGINE, AND ENGINE INCORPORATING SAME

(71) Applicant: HONDA MOTOR CO., LTD., Minato-Ku, Tokyo (JP)

(72) Inventor: Kazuhiro Ikeda, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 29 days.

(21) Appl. No.: 14/620,484

(22) Filed: Feb. 12, 2015

(65) Prior Publication Data

US 2015/0233268 A1 Aug. 20, 2015

(30) Foreign Application Priority Data

Feb. 14, 2014 (JP) ..... 2014-026190

(51) Int. Cl.
*F01L 1/34* (2006.01)
*F01L 1/26* (2006.01)
*F01L 1/053* (2006.01)

(52) U.S. Cl.
CPC ..... *F01L 1/26* (2013.01); *F01L 1/053* (2013.01); *F01L 2250/06* (2013.01)

(58) Field of Classification Search
CPC ..... F01L 1/26; F01L 1/053; F01L 2250/06
USPC ..... 123/90.31
See application file for complete search history.

(56) References Cited

U.S. PATENT DOCUMENTS 7,114,474 B2 * 10/2006 Oshita ..... F02B 75/22 123/90.27
2006/0137636 A1 6/2006 Oshita et al.

FOREIGN PATENT DOCUMENTS

JP 2006-183623 A 7/2006

* cited by examiner

*Primary Examiner* — Zelalem Eshete
(74) *Attorney, Agent, or Firm* — Carrier Blackman & Associates, P.C.; Joseph P. Carrier; William D. Blackman

(57) ABSTRACT

In an internal combustion engine having an idle gear that transmits power received from a crankshaft to valve train systems, an idle shaft that rotatably supports the idle gear, and an outer cover that covers a crankcase from a lateral side, a valve train system drive mechanism includes a crankcase-side boss part is formed on a sidewall of the crankcase, which supports one end of the idle shaft. The drive mechanism also includes a case-cover-side boss part that is formed on the outer cover and supports the other end of the idle shaft. A cover-side joint part and a shaft-side joint part are formed at the case-cover-side boss part and the other end of the idle shaft, respectively, and engagement of the joint parts with each other precludes the idle shaft from rotating.

20 Claims, 12 Drawing Sheets

VALVE TRAIN SYSTEM DRIVE DEVICE FOR AN INTERNAL COMBUSTION ENGINE, AND ENGINE INCORPORATING SAME

CROSS-REFERENCE TO RELATED APPLICATIONS

The present invention claims priority under 35 USC 119 based on Japanese patent application No. 2014-026190, filed on Feb. 14, 2014. The entire subject matter of the referenced priority document, including specification claims and drawings, is incorporated by reference herein.

BACKGROUND OF THE INVENTION

1. Technical Field of the Invention

The present invention relates to a valve train system drive device for an internal combustion engine, and to an engine incorporating the valve train system drive device.

2. Background Art

Conventionally, the concept of a valve train system drive mechanism, that is, a device that transmits the driving force of a crankshaft to an overhead-cam type of valve train system via an idle gear for an internal combustion engine, is known (refer e.g. to Japanese Patent Publication 2006-183623, also published as US pub. 2006/0137636). In the engine disclosed in Japanese Patent Publication 2006-183623, an idle shaft supports an idle gear thereon, and respective ends of the idle shaft are supported by a boss part on a side surface of a crankcase, and by a boss part on a side surface of a crankcase cover. In addition, the idle shaft is fastened to a holder member fastened and fixed to the crankcase cover, and is thereby prevented from rotating.

However, in the above-described known valve train system drive mechanism for an internal combustion engine, a separate holder member is required on the crankcase cover in order to support the idle shaft. Therefore, this known system has problems in respect to size reduction, weight reduction, and simplification of the engine.

SUMMARY OF THE INVENTION

The present invention is made in view of the above-described background circumstances, and it is an object of the present invention to provide a valve train system drive mechanism for an internal combustion engine allowing for size reduction, weight reduction, and simplification of the engine.

Reference numbers are included in the following description, corresponding to the reference numbers used in the drawings. Such reference numbers are provided for illustration and are not intended to limit the invention.

To achieve the above object, the present invention provides a valve train system drive mechanism for an internal combustion engine that is provided in an overhead-cam type engine (1) having a crankshaft (10) provided in a crankcase (11) and dual valve train systems (45*f*, 45*r*). The engine has an idle gear (62) that transmits power received from the crankshaft (10) to the valve train systems (45*f*, 45*r*), an idle shaft (63) that is provided in parallel to the crankshaft (10) and which rotatably supports the idle gear (62), and a case cover (39) that covers the crankcase (11) from a lateral side.

A first aspect of the present invention is characterized by having the following configuration in this valve train system drive device. A crankcase-side boss part (90) is formed on a wall (20*b*) of the crankcase (11) and supports one end (63*b*) of the idle shaft (63), and a case-cover-side boss part (91, 291) is formed inside the case cover (39) and supports another end (63*c*) of the idle shaft (63). Furthermore, joint parts (128, 111), that engage with each other are formed at the case-cover-side boss part (91, 291) and the other end (63*c*) of the idle shaft (63), and engagement of the joint parts (128, 111) with each other precludes the idle shaft (63) from rotating.

According to the first aspect of the present invention, the one end and the other end of the idle shaft are supported by the crankcase-side boss part formed on the wall of the crankcase and by the case-cover-side boss part formed inside the case cover. In addition, the idle shaft can be made incapable of rotating by the joint parts at the other end of the idle shaft. Thus, the structure to support the idle shaft can be simplified. This allows for size reduction, weight reduction, and simplification of the engine.

Furthermore, a second aspect of the present invention is characterized by the following configuration. The idle gear (62) is rotatably supported by the idle shaft (63) with the bearing members (92*a*, 92*b*) interposed therebetween, and an idle shaft oil passage (112) is formed in the idle shaft (63). The idle shaft oil passage (112) is fluidly connected to an oil supply passage (58) formed in the wall (20*b*) of the crankcase (11) at the one end (63*b*) of the idle shaft (63). Furthermore, the case-cover-side boss part (91, 291) has a first abutting surface (123) that abuts against the bearing member (92*a*) in an axial direction, and an oil reservoir (124) having a concave shape is provided at an outer periphery of the first abutting surface (123).

According to the second aspect of the present invention, oil can be supplied to the bearing members from the oil reservoir on the outer peripheral side of the first abutting surface of the case-cover-side boss part, and therefore, the bearing members can be fed with oil by a simple structure.

In addition, a third aspect of the present invention is characterized in that a notch (125, 225) is made in the first abutting surface (123) to allow the first abutting surface (123) to communicate with the oil reservoir (124), and the idle shaft oil passage (112) communicates with the oil reservoir (124) via the notch (125, 225).

According to the third aspect of the present invention, the oil in the oil reservoir can be sufficiently supplied to the bearing members via the notch.

Moreover, a fourth aspect of the present invention is characterized in that a second abutting surface (122) is provided on the case-cover-side boss part at an outer periphery of the oil reservoir (124), and the second abutting surface (122) protrudes in the axial direction relative to the first abutting surface (123).

According to the fourth aspect of the present invention, the capacity of the oil reservoir can be set large, which allows effective oil feed to the bearing members.

Furthermore, a fifth aspect of the present invention is characterized in that a thrust bearing (94) is interposed between the second abutting surface (122) and the idle gear (62).

According to the fifth aspect of the present invention, the thrust bearing can be fed with oil from the oil reservoir.

Furthermore, a sixth aspect of the present invention is characterized in that a second notch (126, 226) to allow the oil reservoir (124) to communicate with a space outside the case-cover-side boss part (91, 291) is made in the second abutting surface (122).

According to the sixth aspect of the present invention, when excess oil is supplied to the oil reservoir, the oil can be discharged to the space outside the case-cover-side boss part.

In addition, a seventh aspect of the present invention is characterized in that a first notch (125, 225) is made in the first abutting surface (123) to allow the first abutting surface (123) to communicate with the oil reservoir (124), and the first notch (125, 225) and the second notch (126, 226) are made at positions different from each other in a circumferential direction of the case-cover-side boss part (91, 291).

According to the seventh aspect of the present invention, oil can be evenly supplied to the oil reservoir and the capacity of the oil reservoir can be efficiently used.

Moreover, an eighth aspect of the present invention is characterized by the following configuration. The first notches (125) are made as a pair of notches with placement in which the first notches (125) are opposed to each other in a radial direction on the ring-shaped abutting surface (123), and the second notches (126) are made as a pair of notches with placement opposed to each other on the second ring-shaped abutting surface (122). Furthermore, a straight line (L1) linking the first notches (125) is substantially orthogonal to a straight line (L2) linking the second notches (126).

According to the eighth aspect of the present invention, oil can be evenly supplied to the oil reservoir, and the capacity of the oil reservoir can be efficiently used.

Furthermore, a ninth aspect of the present invention is characterized in that an idle shaft oil passage (112) is formed in the idle shaft (63), and the oil passage (112) is connected to an oil passage (58) formed in the wall (20*b*) of the crankcase (11) at the one end (63*b*) of the idle shaft (63). In addition, in the ninth aspect hereof, an elastic spring member (95) is interposed between the other end (63*c*) of the idle shaft (63) and the case-cover-side boss part (91, 291).

According to the ninth aspect of the present invention, even when variation is caused in an oil pressure of oil passing through the oil passage in the idle shaft, the idle shaft can be supported in the axial direction by the elastic spring member, and generation of sounds attributed to the vibration of the idle shaft can be reduced or prevented.

Effects of the Invention

With the valve train system drive mechanism for an internal combustion engine according to the present invention, size reduction, weight reduction, and simplification of the engine can be achieved.

Furthermore, the bearing members can be fed with oil by a simple structure.

In addition, the oil in the oil reservoir can be sufficiently supplied to the bearing members via the notch.

Moreover, the capacity of the oil reservoir can be set large, which allows effective oil feed to the bearing members.

Furthermore, the thrust bearing can be fed with oil from the oil reservoir.

In addition, when excess oil is supplied to the oil reservoir, the oil can be discharged to the space outside the case-cover-side boss part.

Moreover, oil can be evenly supplied to the oil reservoir and the capacity of the oil reservoir can be efficiently used.

Furthermore, generation of sounds attributed to vibration of the idle shaft can be reduced or prevented.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

An internal combustion engine including an improved valve train system drive mechanism, according to a first illustrative embodiment of the present invention, will be described below with reference to the drawings. Throughout the following description, relative terms like "upper", "lower", "above", "below", "front", "back", and the like are used in reference to a vantage point of an operator of the vehicle, seated on the driver's seat and facing forward. It should be understood that these terms are used for purposes of illustration, and are not intended to limit the invention.

Figure 1:
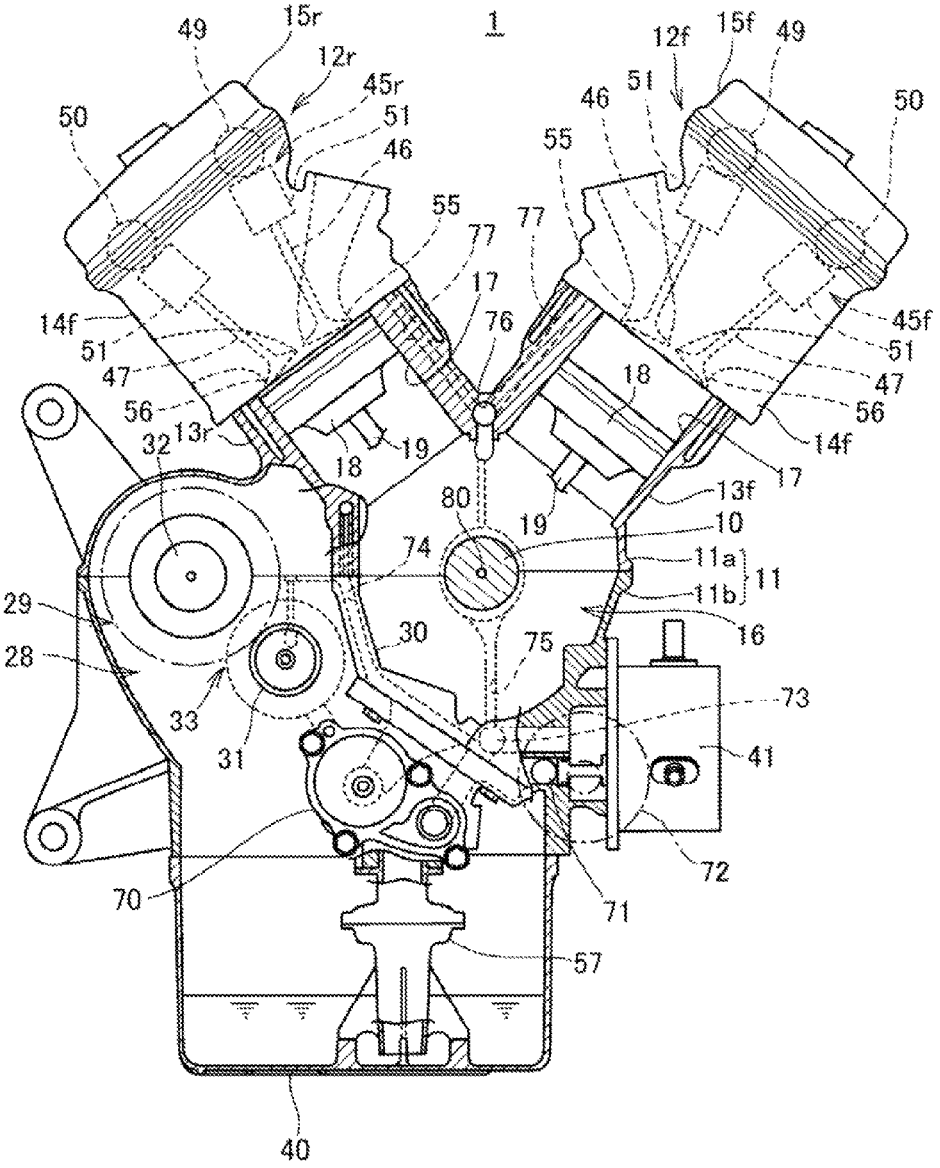
FIG. 1 is a side plan view of an engine, partially shown in cross-section and including a valve train system drive device of the present invention.

FIG. 1 is a side plan view of an engine, partially shown in cross-section and including a valve train system drive device of the present invention.

As shown in FIG. 1, in the depicted embodiment, the engine 1 is a four-cylinder V-type quad overhead cam engine configured to be mounted in a motorcycle (not shown). The engine 1 includes a crankcase 11 in which a crankshaft 10 is housed, a first bank 12*f* that tilts forward and extends forward and upward from the upper part of the crankcase 11, and a second bank 12*r* that tilts rearward and extends rearward and upward from the upper part of the crankcase 11. The first bank 12*f* and the second bank 12*r* respectively include cylinder blocks 13*f* and 13*r*, cylinder heads 14*f* and 14*r* joined to the upper surfaces of the cylinder blocks 13*f* and 13*r*, and head covers 15*f* and 15*r* that cover the upper surfaces of the cylinder heads 14*f* and 14*r*.

The crankcase 11 is formed with a vertically-split structure and includes an upper case 11*a* and a lower case 11*b* joined to the lower surface of the upper case 11*a*. The cylinder blocks 13*f* and 13*r* are formed monolithically with the upper case 11*a*.

An oil pan 40 for storing and circulating oil is provided on the lower surface of the lower case 11*b*. An oil cooler 41 is provided on the front surface of the lower case 11*b*.

The engine 1 is configured to be mounted transversely in the motorcycle in an orientation such that the crankshaft 10 is oriented along the vehicle width direction, and the oil cooler 41 is located on the front surface of the engine 1.

Figure 2:
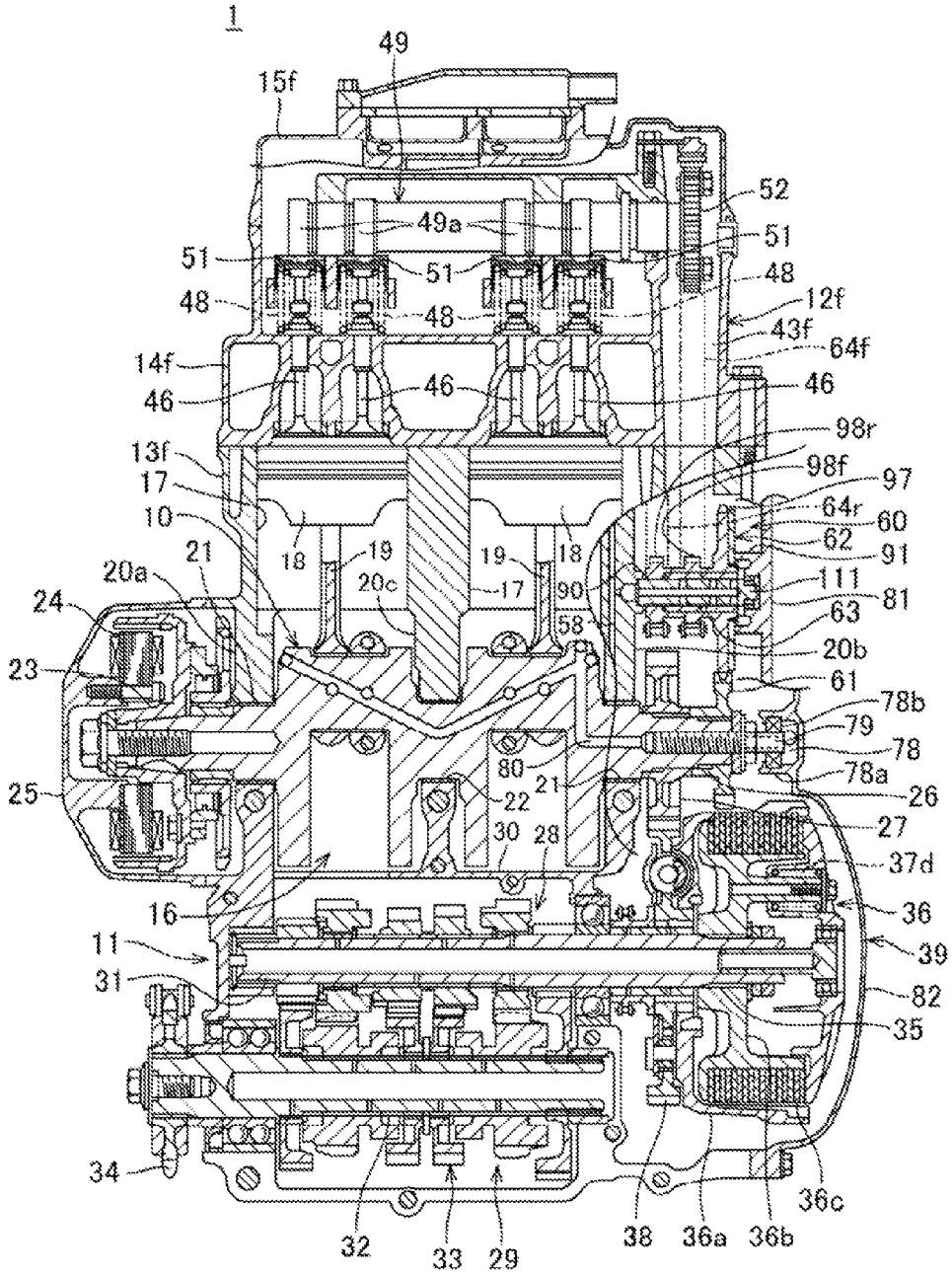
FIG. 2 is a cross-sectional view of the engine of FIG. 1, obtained by cutting the engine along a plane traversing the engine along the axial direction of a crankshaft.

FIG. 2 is a sectional view obtained by cutting the engine 1 by a plane traversing the engine 1 along the axial direction of the crankshaft 10. The first bank 12*f* and the second bank 12*r* are similarly formed. Therefore, in FIG. 2, a section of the first bank 12*f* is shown and corresponding diagrammatic representation of a section of the second bank 12*r* is omitted.

As shown in FIGS. 1 and 2, the crankshaft 10 is housed in a crank chamber 16 at the front part of the crankcase 11, and a pair of cylinder bores 17 are made in each of the cylinder blocks 13*f* and 13*r* over the crank chamber 16. Pistons 18 are provided in the cylinder bores 17 and are joined to the crankshaft 10 via connecting rods 19.

The crankshaft 10 is supported by crank support parts 21 made in left and right sidewalls 20*a* and 20*b* of the crankcase 11 and a crank support part 22 made in an internal wall 20*c* in the crank chamber 16. The crank support parts 21 and 22 are made at the connecting part between the upper case 11*a* and the lower case 11*b*.

The crankshaft 10 has, at one end, a protrusion part 23 protruding outward from the sidewall 20*a* on the left side (one side), and a generator 24 is provided at the protrusion part 23. The generator 24 is covered by a generator cover 25 attached to the sidewall 20*a*.

The crankshaft 10 has, at the other end, a protrusion part 26 protruding outward from the sidewall 20*b* (wall of the crankcase) on the right side (the other side), and a primary drive gear 27 is provided at the protrusion part 26.

A transmission chamber 28 is set at the rear part of the crankcase 11 and a constant mesh gear transmission 29 is housed in the transmission chamber 28. The transmission chamber 28 and the crank chamber 16 are compartmentalized in the front-rear direction by a partition wall 30.

The gear transmission 29 includes a main shaft 31 provided in parallel to the crankshaft 10, a countershaft 32 provided in parallel to the main shaft 31, and a gear train 33 provided between the main shaft 31 and the countershaft 32. The countershaft 32 has an end part protruding outward from the sidewall 20*a*. At this end part, a drive sprocket 34 that drives a driven sprocket of a rear wheel through a chain is provided.

The main shaft 31 includes a clutch support part 35 protruding outward from the sidewall 20*b* and a clutch system 36 is provided at the clutch support part 35. The clutch system 36 is a well-known one including a clutch outer 36*a* provided on the clutch support part 35 rotatably relative to the main shaft 31, a clutch inner 36*b* fixed to the main shaft 31, a friction plate 36*c* provided between the clutch inner 36*b* and the clutch outer 36*a*, and a clutch spring 37*d*. To the clutch outer 36*a*, a primary driven gear 38 meshing with the primary drive gear 27 is fixed.

The clutch system 36 and the primary drive gear 27 are covered by a clutch cover 39 (case cover) attached to a side surface of the crankcase 11.

Over the primary drive gear 27, a pair of cam chain chambers (timing chambers) 43*f* and 43*r* extending in the upward-downward direction in the engine 1 along the sidewall 20*b* to the sides of the head covers 15*f* and 15*r* are formed. The cam chain chambers 43*f* and 43*r* unite with each other at the lower parts and form one chamber near the protrusion part 26.

Valve train mechanisms 45*f* and 45*r* (valve train systems) of the overhead-camshaft type are provided at the upper parts of the cylinder heads 14*f* and 14*r*, respectively. The valve train mechanisms 45*f* and 45*r* are formed similarly between the first bank 12*f* and the second bank 12*r*. Therefore, the valve train mechanism 45*f* of the first bank 12*f* will be mainly described herein, and corresponding components formed in the same manner as the valve train mechanism 45*f* in the valve train mechanism 45*r* are given the same symbols.

The valve train mechanism 45*f* includes intake valves 46, exhaust valves 47, valve springs 48 that bias the intake valves 46 and the exhaust valves 47 in the valve-closing direction, valve lifters 51 that press the intake valves 46 and the exhaust valves 47 in the valve-opening direction, an intake camshaft 49 provided on the intake side, and an exhaust camshaft 50 provided on the exhaust side. For each cylinder, a pair of intake valves 46 and a pair of exhaust valves 47 are provided.

The intake camshaft 49 has cam lobes 49*a* provided with predetermined height and phase. The cam lobes 49*a* selectively press the intake valves 46 through the valve lifters 51 in association with the rotation of the intake camshaft 49. Therefore, the intake valves 46 move and intake ports 55 of the cylinder heads 14*f* and 14*r* are selectively opened and closed.

The exhaust camshaft 50 has cam lobes (not shown) provided with predetermined height and phase. The cam lobes selectively press the exhaust valves 47 through the valve lifters 51 in association with the rotation of the exhaust camshaft 50. Therefore, the exhaust valves 47 move and exhaust ports 56 of the cylinder heads 14*f* and 14*r* are selectively opened and closed.

Figure 3:
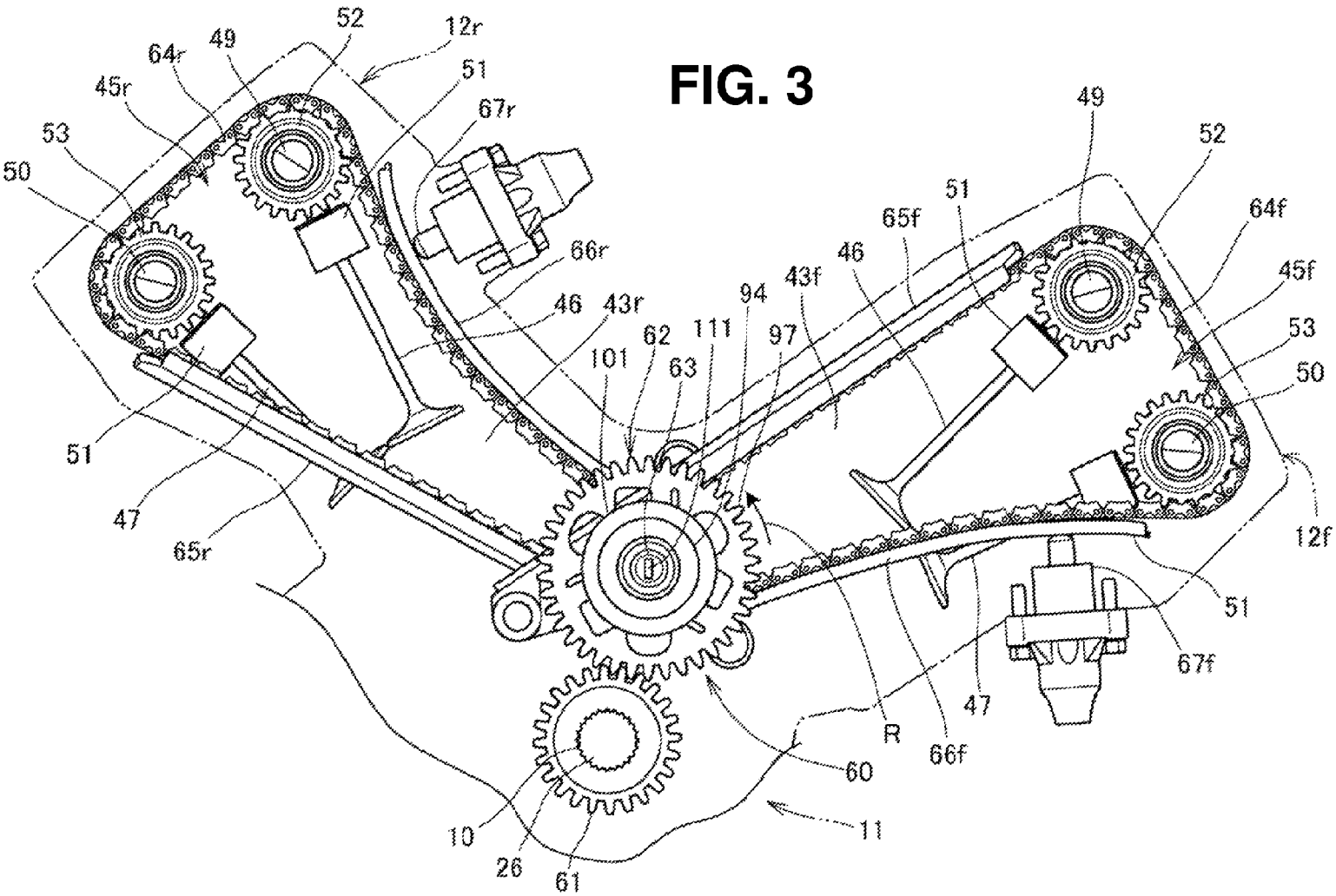
FIG. 3 is a side view showing a timing chain and gear structure around valve train mechanisms.

FIG. 3 is a side view showing timing chain and gear structure around valve train mechanisms.

Referring to FIGS. 1 to 3, the intake camshaft 49 and the exhaust camshaft 50 are provided in parallel to the crankshaft 10.

In the first bank 12*f*, the intake camshaft 49 has an intake-side driven sprocket 52 at the part protruding into the cam chain chamber 43*f*. The exhaust camshaft 50 has an exhaust-side driven sprocket 53 at the part protruding into the cam chain chamber 43*f*.

In the second bank 12*r*, the intake camshaft 49 has the intake-side driven sprocket 52 at the part protruding into the cam chain chamber 43*r*. The exhaust camshaft 50 has the exhaust-side driven sprocket 53 at the part protruding into the cam chain chamber 43*r*.

The valve train mechanisms 45*f* and 45*r* are driven by a valve train system drive device 60 provided in the engine 1.

The valve train system drive device 60 includes the following components: an idler drive gear 61 provided at the protrusion part 26 of the crankshaft 10; an idle gear 62 meshing with the idler drive gear 61; an idle shaft 63 that rotatably supports the idle gear 62; a first-bank-side cam chain (timing chain) 64*f* that transmits the rotation of the idle gear 62 to the intake-side driven sprocket 52 and the exhaust-side driven sprocket 53 in the first bank 12*f*; and a second-bank-side cam chain (timing chain) 64*r* that transmits the rotation of the idle gear 62 to the intake-side driven sprocket 52 and the exhaust-side driven sprocket 53 in the second bank 12*r*.

The first bank 12*f* and the second bank 12*r* are so disposed as to be offset from each other in the axial direction of the crankshaft 10. Corresponding to this, the first-bank-side cam chain 64*f* and the second-bank-side cam chain 64*r* are also so disposed as to be offset from each other in the vehicle width direction.

The idler drive gear 61 is formed with a smaller diameter than the primary drive gear 27 and is disposed on the shaft end side of the crankshaft 10 relative to the primary drive gear 27.

The idle gear 62 is rotated in a rotational direction R in FIG. 3 through the idler drive gear 61.

In the cam chain chamber 43*f*, a chain guide 65*f* in contact with the outer circumference of the first-bank-side cam chain 64*f* on the tight side and a chain tensioner 66*f* in contact with the outer circumference of the first-bank-side cam chain 64*f* on the loose side are provided.

In the cam chain chamber 43*r*, a chain guide 65*r* in contact with the outer circumference of the second-bank-side cam chain 64*r* on the tight side and a chain tensioner 66*r* in contact with the outer circumference of the second-bank-side cam chain 64*r* on the loose side are provided.

The lower end parts of the chain guides 65*f* and 65*r* and the chain tensioners 66*f* and 66*r* are located closer to the sidewall 20*b* than the idle gear 62 near the crankshaft 10 and overlap with the idle gear 62 in side view.

Furthermore, in the cam chain chamber 43*f*, a tensioner lifter 67*f* that biases the chain tensioner 66*f* toward the first-bank-side cam chain 64*f* is provided. In the cam chain chamber 43*r*, a tensioner lifter 67*r* that biases the chain tensioner 66*r* toward the second-bank-side cam chain 64*r* is provided.

As shown in FIG. 1, at the lower part of the crankcase 11, an oil pump 70 driven by power of the crankshaft 10 is provided. An oil strainer 57 extending to the bottom part of the oil pan 40 is connected to the oil pump 70 and the oil pump 70 sends oil sucked from the oil strainer 57 to the respective parts of the engine 1.

The oil discharged from the oil pump 70 passes through an oil passage 71 at the front part of the crankcase 11 and reaches an oil filter 72. Then, after passing through the oil filter 72 to be purified, the oil flows into the oil cooler 41 to be cooled. The oil that has passed through the oil cooler 41 flows into a main gallery 73 extending in substantially parallel to the crankshaft 10 below the crankshaft 10 and flows from the main gallery 73 to the respective lubrication points through branching.

Part of the oil branched from the main gallery 73 passes through an oil passage 74 in the partition wall 30 and is supplied to the gear transmission 29. Furthermore, part of the oil branched from the main gallery 73 is sent from plural oil passages 75 made in the crankcase 11 to the upper side and the crank support parts 21 and 22 are lubricated with the oil.

Part of the oil that has reached the crank support parts 21 and 22 flows into an upper oil passage 76 made in substantially parallel to the main gallery 73 at the upper part of the crankcase 11 and part of the oil in the upper oil passage 76 is injected toward the pistons 18. Moreover, part of the oil in the upper oil passage 76 passes through oil passages 77 running in the upward-downward direction in the first bank 12*f* and the second bank 12*r* and is supplied to the valve train mechanisms 45*f* and 45*r*.

Furthermore, part of the oil branched from the main gallery 73 passes through an oil passage 85 (FIG. 5) and reaches an oil chamber 78 (FIG. 2) set inside the clutch cover 39. Specifically, the oil chamber 78 has a cylindrical part 78*a* provided on the clutch cover 39 and a sealing member 78*b* that closes the end of the cylindrical part 78*a*. The oil in the oil chamber 78 passes through a pipe 79 that penetrates the sealing member 78*b* and is connected to a shaft end of the crankshaft 10, and reaches a shaft oil passage 80 in the crankshaft 10. The oil in the shaft oil passage 80 is supplied to the joint parts between the crankshaft 10 and the connecting rods 19, and so forth.

Figure 4:
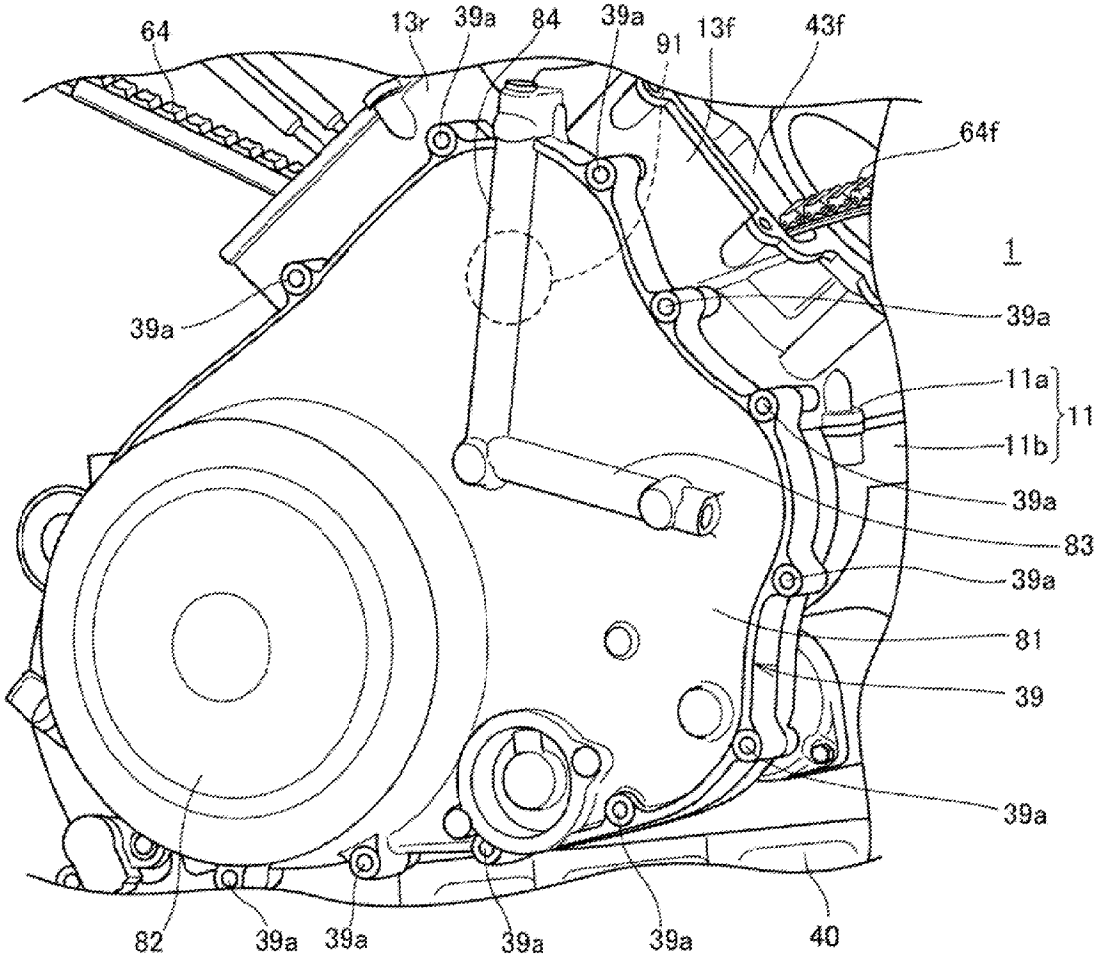
FIG. 4 is a perspective view of a part around a cover member as viewed from the outside.
Figure 5:
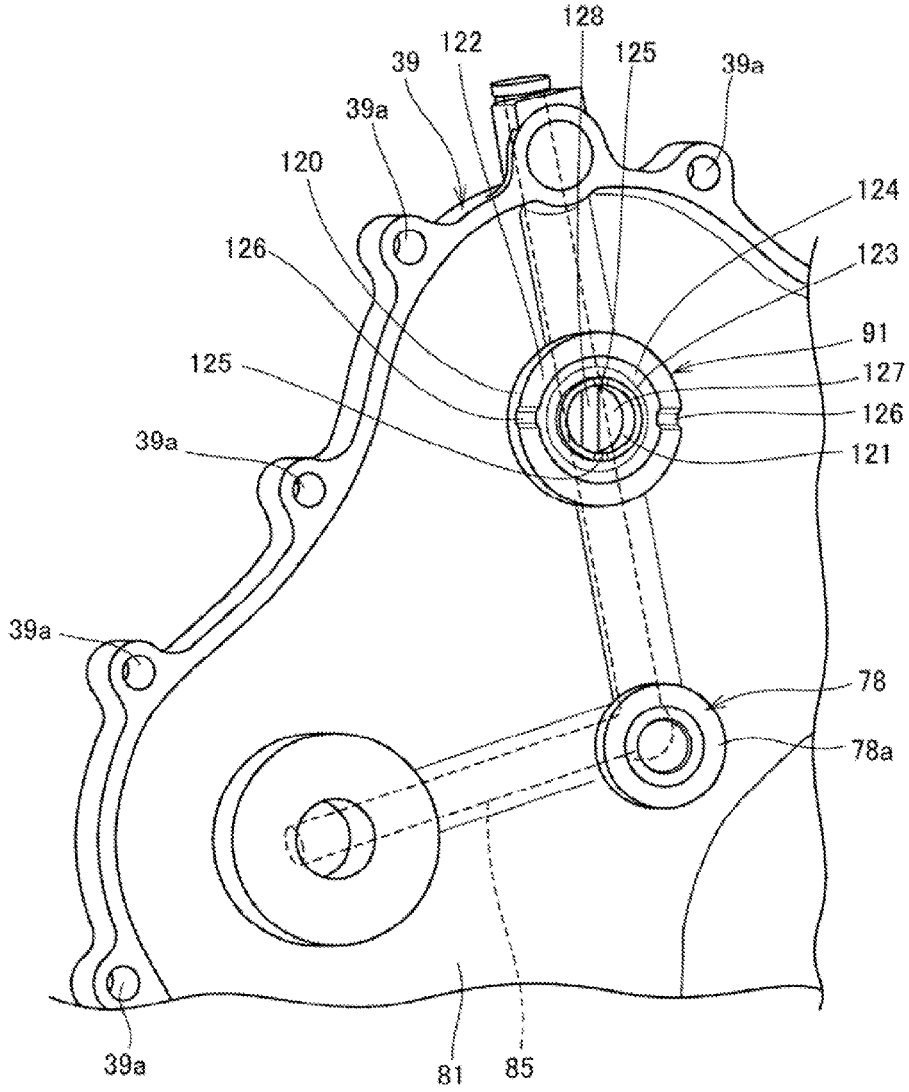
FIG. 5 is a diagram of the cover member as viewed from the inside.

FIG. 4 is a perspective view of the part around the clutch cover 39 as viewed from the outside. FIG. 5 is a diagram of the clutch cover 39 as viewed from the inside. In FIG. 4, a state in which the cylinder heads 14*f* and 14*r* are removed is shown.

As shown in FIGS. 2, 4, and 5, the clutch cover 39 monolithically has a side cover part 81 that has a substantially flat plate shape and covers the protrusion part 26 of the crankshaft 10, the idler drive gear 61, and so forth from the lateral outside and a clutch cover part 82 that covers the clutch system 36 from the outside on the rear side of the side cover part 81.

The side cover part 81 covers the range from the upper part of the crankcase 11 near the cylinder blocks 13*f* and 13*r* to the lower part of the crankcase 11. The clutch cover part 82 is formed into a bottomed cylindrical shape along the clutch system 36 and bulges toward the lateral outside relative to the side cover part 81.

The clutch cover 39 has plural fixing holes 39*a* at the peripheral part and is fixed to a side surface of the crankcase 11 by cover fixing bolts (not shown) inserted into the fixing holes 39*a*. In the side surface of the crankcase 11, plural fixing holes 11*c* into which the cover fixing bolts are fastened are made.

*On the outer surface of the side cover part 81, a pipe-shaped part 83 extending in the front-rear direction and a pipe-shaped part 84 extending upward from the rear end of the pipe-shaped part 83 are formed. The oil passage 85 is formed inside the pipe-shaped part 83 and the pipe-shaped part 84. The oil passage 85 is connected to the main gallery 73 and is connected to the upper oil passage 76 via the upper end part of the pipe-shaped part 84. Furthermore, the oil passage 85 communicates with the oil chamber 78 at the rear end part of the pipe-shaped part 83 and part of the oil in the main gallery 73 passes through the oil passage 85 to be supplied to the oil chamber 78**.

Figure 6:
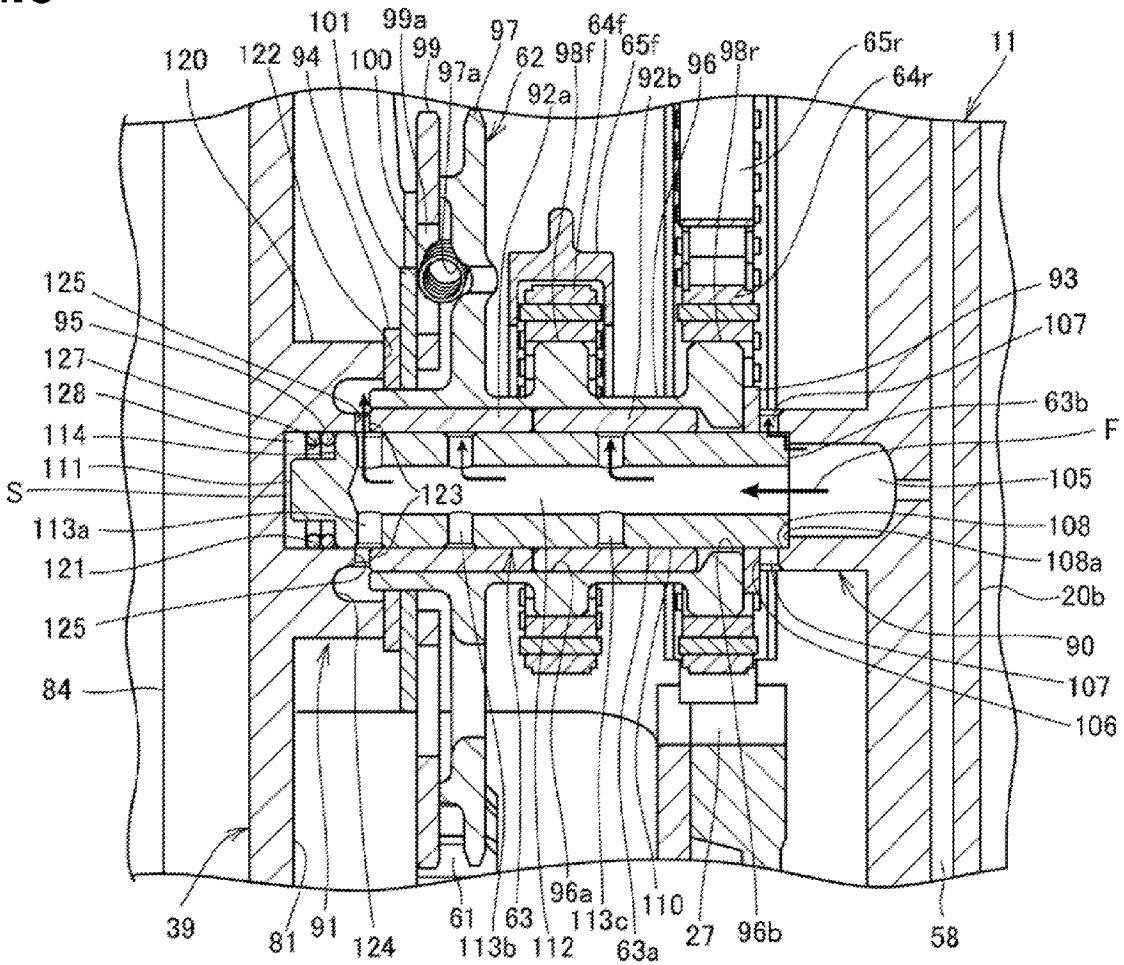
FIG. 6 is a cross-sectional detail view of a part of the engine around an idle shaft supporting an idle gear thereon.
Figure 7:
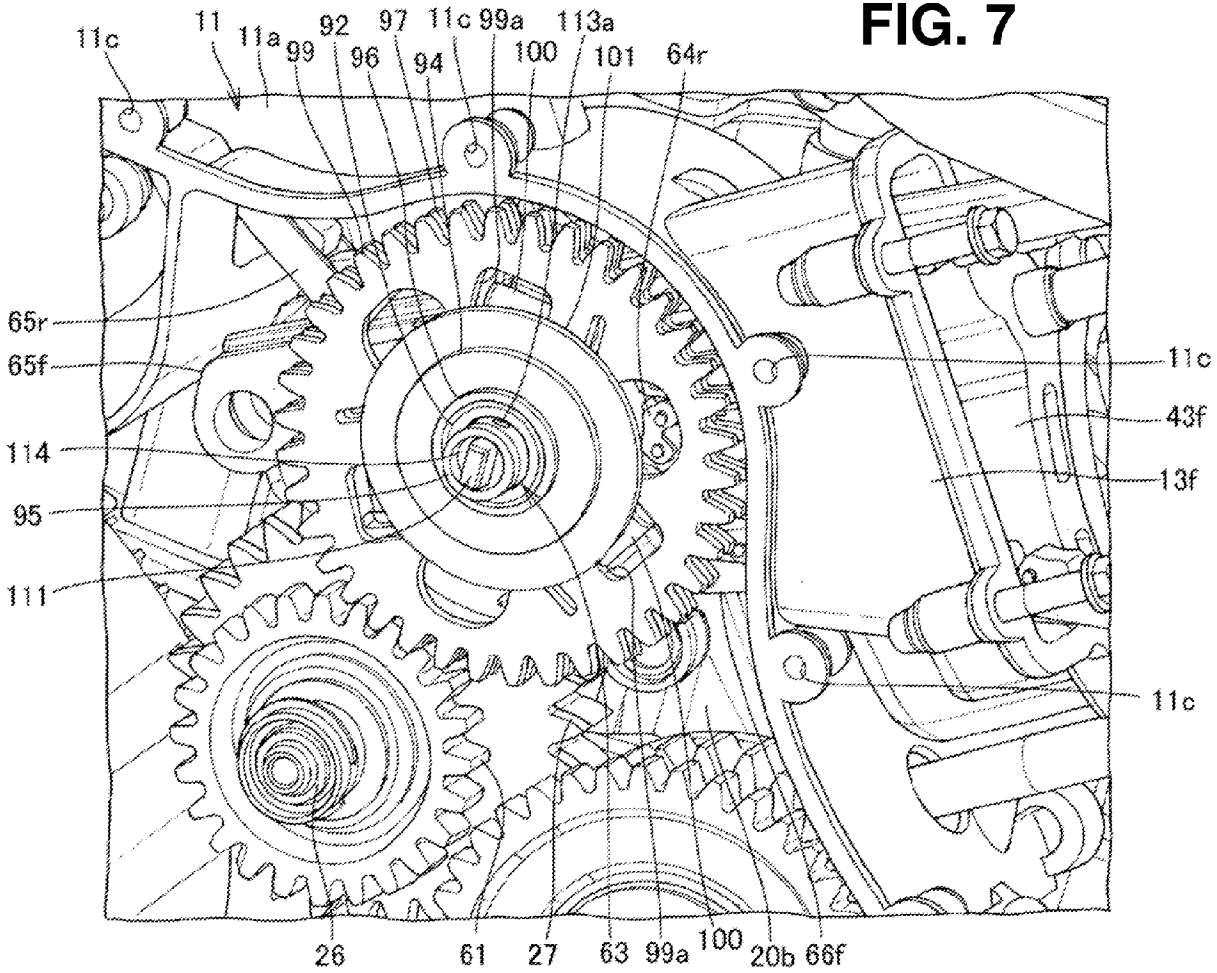
FIG. 7 is a perspective detail view of the part of the engine around the idle gear as viewed from a lateral side.
Figure 8:
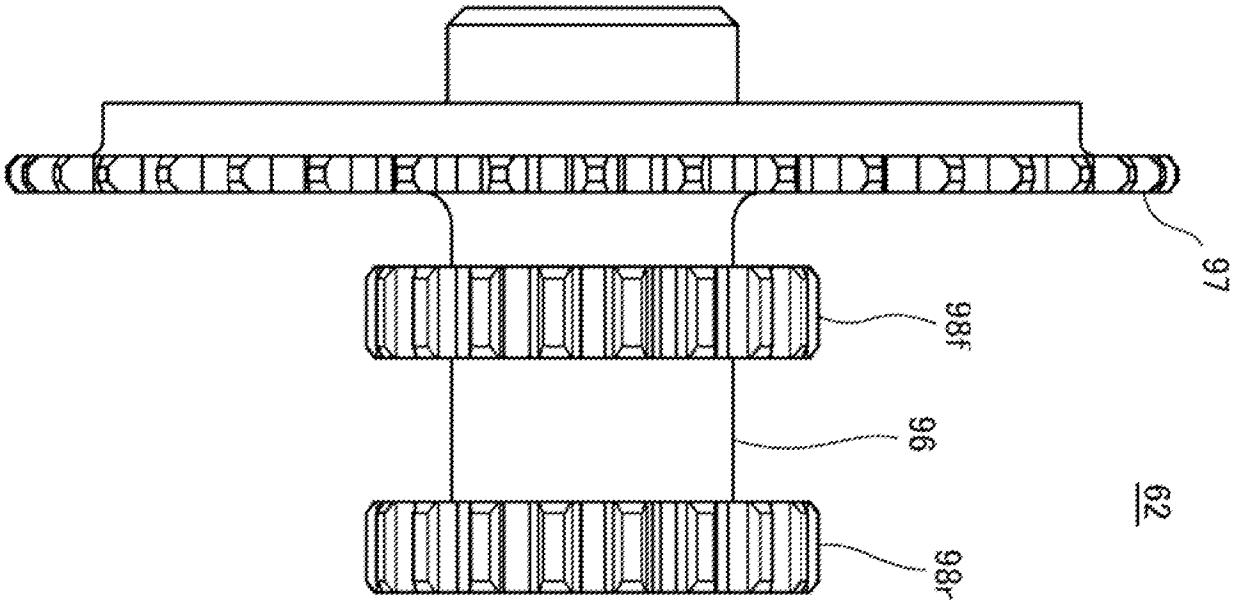
FIG. 8 is a top plan view of the idle gear.

FIG. 6 is a sectional view of the part around the idle gear 62. FIG. 7 is a perspective view of the part around the idle gear 62 as viewed from the lateral side. FIG. 8 is a plan view of the idle gear 62.

Referring to FIGS. 2, 3, and 6 to 8, both ends of the idle shaft 63 are supported by a crankcase-side boss part 90 provided on the sidewall 20*b* of the crankcase 11 and a case-cover-side boss part 91 provided on the clutch cover 39.

The idle gear 62 is rotatably journaled by the idle shaft 63 with the intermediary of a pair of bearings 92*a* and 92*b* (bearing members) fitted to outer circumference 63*a* of the idle shaft 63.

For example, the bearings 92*a* and 92*b* are roller bearings each having a cylindrical case and plural rollers held on the outer circumferential part of this case.

A case-side thrust bearing 93 having a ring shape is interposed between one end of the idle gear 62 and the crankcase-side boss part 90. Furthermore, a cover-side thrust bearing 94 (thrust bearing) having a ring shape is interposed between the other end of the idle gear 62 and the case-cover-side boss part 91. Moreover, a coil-shaped spring 95 (elastic spring member) that biases the idle shaft 63 in the axial direction is provided between the idle shaft 63 and the case-cover-side boss part 91.

The idle gear 62 monolithically has the following parts: a cylindrical shaft part 96 fitted to the outer circumference of the bearings 92*a* and 92*b*; an idler driven gear 97 that is provided on the outer circumference of the shaft part 96 and meshes with the idler drive gear 61; a first-bank-side drive sprocket 98*f* that is provided on the shaft part 96 and meshes with the first-bank-side cam chain 64*f*; and a second-bank-side drive sprocket 98*r* that is provided on the shaft part 96 and meshes with the second-bank-side cam chain 64*r*.

The first-bank-side cam chain 64*f* is passed around the first-bank-side drive sprocket 98*f* and the intake-side driven sprocket 52 and the exhaust-side driven sprocket 53 in the first bank 12*f*. The second-bank-side cam chain 64*r* is passed around the second-bank-side drive sprocket 98*r* and the intake-side driven sprocket 52 and the exhaust-side driven sprocket 53 in the second bank 12*r*. That is, the valve train mechanisms 45*f* and 45*r* are driven by the first-bank-side cam chain 64*f* and the second-bank-side cam chain 64*r* driven by one idle gear 62 provided over the crankshaft 10. By driving the valve train mechanisms 45*f* and 45*r* by the idle gear 62 over the crankshaft 10 in this manner, the first-bank-side cam chain 64*f* and the second-bank-side cam chain 64*r* can be shortened and weight reduction can be achieved.

The idler driven gear 97 is provided on the other end side of the idle gear 62 and the second-bank-side drive sprocket 98*r* is provided on the one end side of the idle gear 62. The first-bank-side drive sprocket 98*f* is provided between the idler driven gear 97 and the second-bank-side drive sprocket 98*r*. The first-bank-side drive sprocket 98*f* and the second-bank-side drive sprocket 98*r* have a smaller diameter than the idler driven gear 97.

For the idler driven gear 97, a sub-gear 99 is so provided as to abut against the outer surface of the idler driven gear 97. The sub-gear 99 has the same number of teeth and substantially the same diameter as the idler driven gear 97 and is fitted to the shaft part 96. Between the sub-gear 99 and the idler driven gear 97, springs 100 extending in the circumferential direction of the idler driven gear 97 are interposed at plural places. Specifically, the spring 100 is provided in both a recess 97*a* made in the idler driven gear 97 and a hole 99*a* made in the sub-gear 99. Through deflection of the springs 100, the sub-gear 99 rotates relative to the idler driven gear 97.

A ring-shaped washer 101 fitted to the shaft part 96 is interposed between the sub-gear 99 and the cover-side thrust bearing 94. The washer 101 is pressed by the cover-side thrust bearing 94 and makes the sub-gear 99 abut against the idler driven gear 97. Furthermore, the washer 101 is located outside the spring 100 to prevent the removal of the spring 100.

A bearing fitting part 96*a* to which the bearings 92*a* and 92*b* are fitted is provided on the inner circumferential surface of the shaft part 96 and a projection 96*b* that restricts the position of the bearings 92*a* and 92*b* in the axial direction is provided on the inner circumferential surface of one end of the shaft part 96. When the position of the bearings 92*a* and 92*b* is settled by the projection 96*b*, the position of the end surface of the outside bearing 92*a* substantially corresponds with the position of the end surface of the shaft part 96 on the opposite side to the projection 96*b*.

Figure 9:
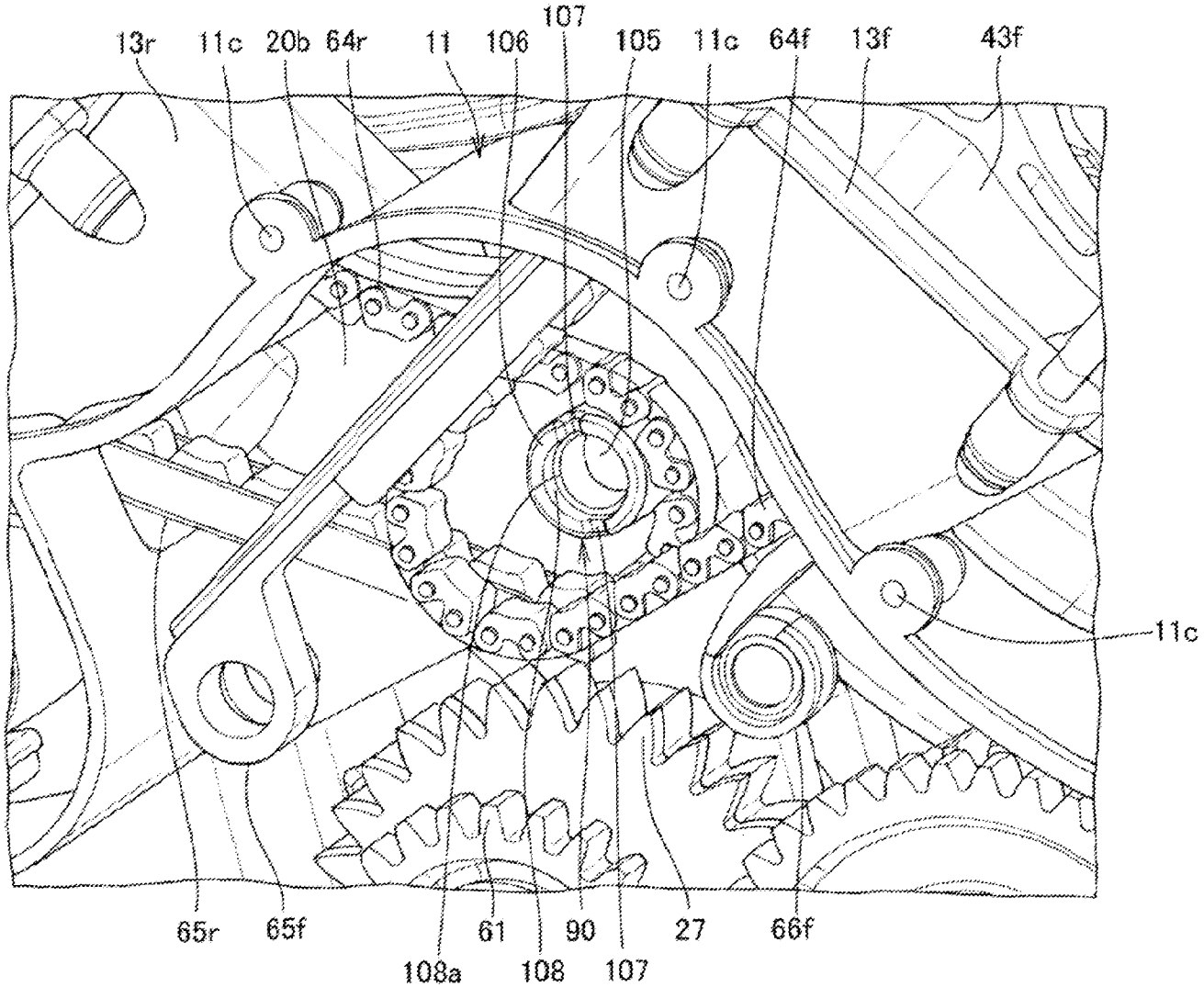
FIG. 9 is a perspective detail view showing a part of the engine around a crankcase-side boss part.

FIG. 9 is a perspective view showing the part around the crankcase-side boss part 90.

As shown in FIGS. 6 and 9, the crankcase-side boss part 90 is provided over the idler drive gear 61 at the lower part of the cam chain chambers 43*f* and 43*r*. The crankcase-side boss part 90 is formed into a cylindrical shape protruding from the sidewall 20*b* toward the clutch cover 39 in parallel to the crankshaft 10.

In the sidewall 20*b*, a case-side oil passage 58 (oil passage formed in the wall of the crankcase) that is branched from the main gallery 73 and extends in the upward-downward direction in the sidewall 20*b* is made. The inner circumferential part of the crankcase-side boss part 90 serves as an oil passage 105 communicating with the case-side oil passage 58.

The crankcase-side boss part 90 has, at the tip, a substantially flat abutting surface 106 that abuts against the case-side thrust bearing 93 and tip notches 107 to allow the inside of the crankcase-side boss part 90 to communicate with the outside are made in the first abutting surface 106. The tip notches 107 are made at the upper part and lower part of the crankcase-side boss part 90 as a pair of notches with a positional relationship in which they are opposed to each other. Part of oil pressure-fed to the oil passage 105 passes through the gap between the crankcase-side boss part 90 and the idle shaft 63 and is supplied from the tip notches 107 to the case-side thrust bearing 93.

In the inner circumferential surface of the tip part of the crankcase-side boss part 90, a shaft fitting part 108 formed with a larger diameter than the back side of the oil passage 105 is made. One end 63*b* of the idle shaft 63 is fitted to the shaft fitting part 108. The shaft fitting part 108 has, at the bottom part, a step part 108*a* against which the one end 63*b* of the idle shaft 63 is made to abut.

Figure 10:
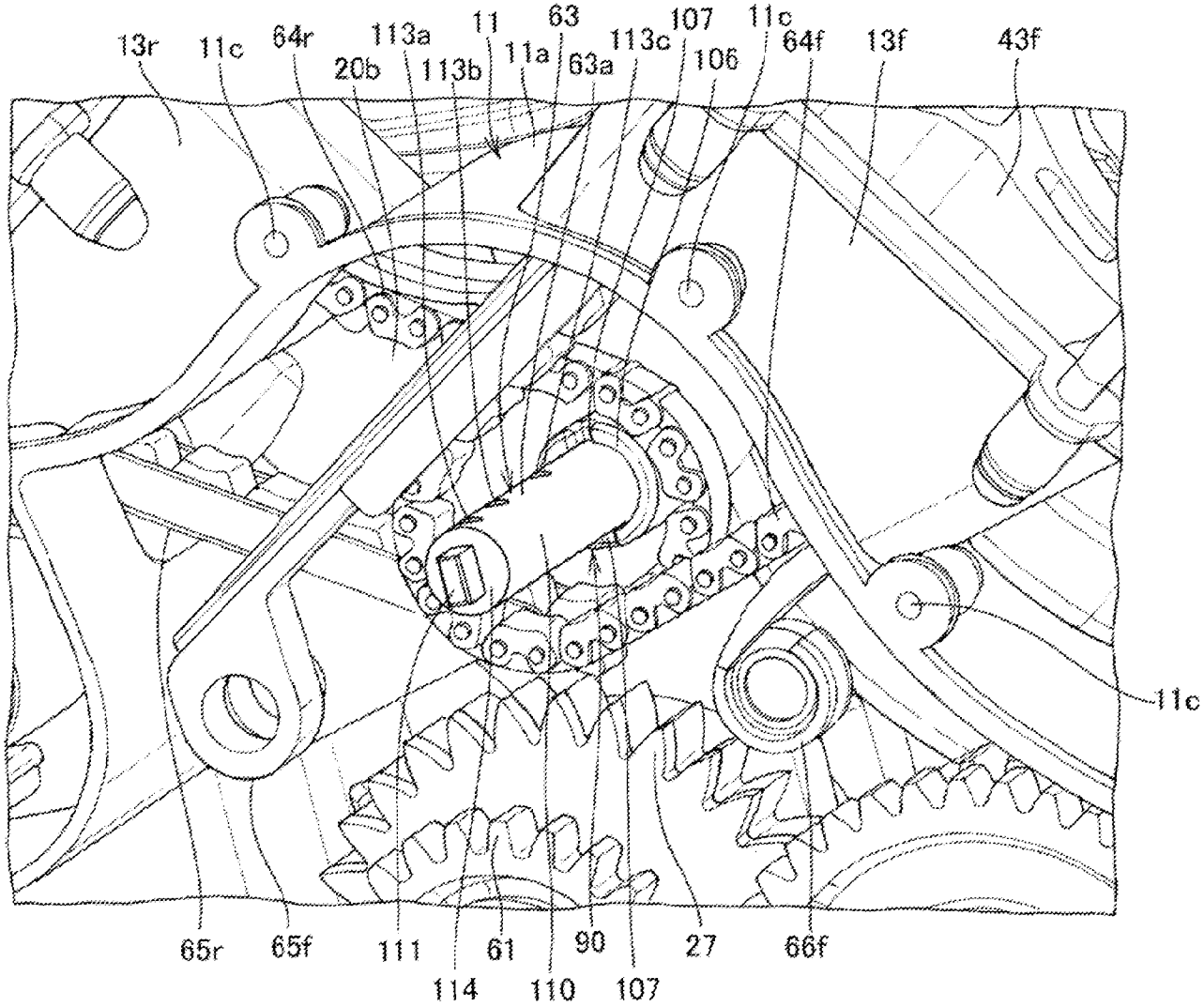
FIG. 10 is a perspective detail view similar to FIG. 9, showing a state in which an idle shaft is attached to the crankcase-side boss part.

FIG. 10 is a perspective view showing a state in which the idle shaft 63 is attached to the crankcase-side boss part 90.

As shown in FIGS. 6 and 10, the idle shaft 63 includes a shaft main body part 110 that extends in parallel to the crankshaft 10 and has a circular sectional shape and a shaft-side joint part 111 (joint part) protruding in the axial direction from the shaft main body part 110.

The shaft main body part 110 has an in-shaft oil passage 112 (oil passage) extending along the axial direction at a position substantially corresponding with the position of the axial line of the shaft main body part 110. The in-shaft oil passage 112 communicates with the oil passage 105 at the one end 63*b*. Furthermore, the in-shaft oil passage 112 extends to the vicinity of the shaft-side joint part 111 and ends there. Thus, the in-shaft oil passage 112 does not penetrate the idle shaft 63 in the axial direction at the other end 63*c* of the idle shaft 63. The inner diameter of the in-shaft oil passage 112 is set smaller than that of the oil passage 105. Therefore, the idle shaft 63 is formed with a thick wall and its strength and rigidity are ensured.

The shaft main body part 110 has plural oil passages 113*a*, 113*b*, and 113*c* extending in the radial direction to allow the oil passage 105 to communicate with the outer circumference 63*a*. In the assembled state, the oil passage 113*a* is made on the tip side of the other end 63*c*. Furthermore, the oil passage 113*b* is made near the idler driven gear 97 and the oil passage 113*c* is made near the first-bank-side drive sprocket 98*f*. The shaft main body part 110 is formed longer than the idle gear 62 in the axial direction.

A substantially flat end surface 114 is made at the tip part of the shaft main body part 110 on the side of the other end 63*c* and the shaft-side joint part 111 protrudes in the axial direction from the center of the end surface 114. The shaft-side joint part 111 is formed into a substantially oblong rectangular shape as viewed in the axial direction.

Figure 11:
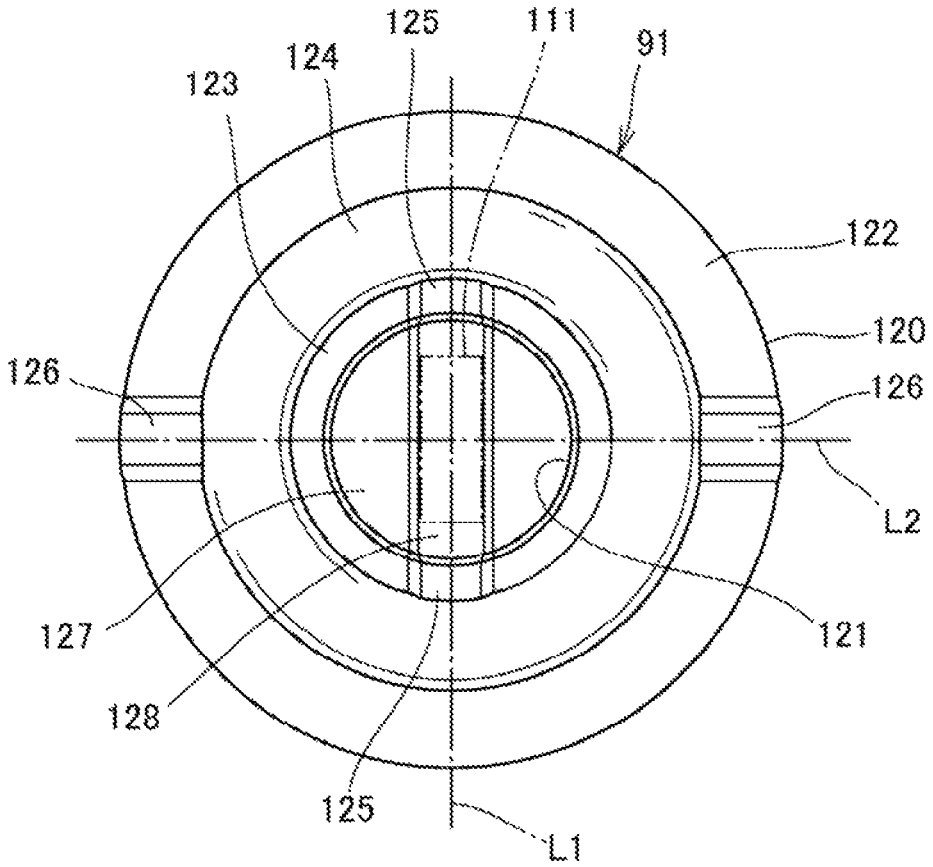
FIG. 11 is a plan view of a case-cover-side boss part.

FIG. 11 is a plan view of the case-cover-side boss part 91.

As shown in FIGS. 5, 6, and 11, the case-cover-side boss part 91 is provided on the inner surface of the side cover part 81 of the clutch cover 39 and is located above the oil chamber 78. The case-cover-side boss part 91 is formed into a cylindrical shape protruding from the side cover part 81 toward the sidewall 20*b* in parallel to the crankshaft 10.

The case-cover-side boss part 91 has a cylindrical part 120 having a larger diameter than the idle shaft 63 and a fitting hole 121 made at the center of the cylindrical part 120.

As shown in FIGS. 4 and 5, the oil passage 85 in the pipe-shaped part 84 is so made as to overlap with the case-cover-side boss part 91 but does not communicate with the fitting hole 121.

The tip part of the cylindrical part 120 has an outside abutting surface 122 (second abutting surface) that protrudes in the axial direction on the outer circumferential side of the cylindrical part 120 and has a circular ring shape in plan view and an inside abutting surface 123 (abutting surface) that protrudes in the axial direction on the inner circumferential side of the cylindrical part 120 and has a circular ring shape in plan view. The outside abutting surface 122 protrudes in the axial direction to a larger extent than the inside abutting surface 123.

Between the outside abutting surface 122 and the inside abutting surface 123, an oil reservoir 124 that hollows in the axial direction relative to the inside abutting surface 123 and has a circular ring shape in plan view is formed.

The outside abutting surface 122 has such a diameter as to overlap with the cover-side thrust bearing 94 as viewed in the axial direction and abuts against the cover-side thrust bearing 94 in the axial direction. The inside abutting surface 123 has such a diameter as to overlap with the bearing 92*a* and abuts against the end surface of the outside bearing 92*a* in the axial direction. The oil reservoir 124 has such a diameter as to overlap with the bearing 92*a*, the shaft part 96, and the cover-side thrust bearing 94 and is opposed to the bearing 92*a*, the shaft part 96, and the cover-side thrust bearing 94 in the axial direction.

The inside abutting surface 123 has inside notches 125 (notches) to allow the inside abutting surface 123 to communicate with the oil reservoir 124. The oil reservoir 124 communicates with the oil passage 113*a* via the inside notches 125. The inside notches 125 are made at the upper part and lower part of the inside abutting surface 123 as a pair of notches with a positional relationship in which they are substantially opposed to each other as viewed in the axial direction.

The outside abutting surface 122 has outside notches 126 (second notches) to allow the oil reservoir 124 to communicate with a space outside the case-cover-side boss part 91. The outside notches 126 are made at the left and right side parts of the outside abutting surface 122 as a pair of notches with a positional relationship in which they are substantially opposed to each other as viewed in the axial direction. A straight line L1 linking the pair of inside notches 125 is substantially orthogonal to a straight line L2 linking the pair of outside notches 126.

The part of the shaft main body part 110 of the idle shaft 63 on the side of the end surface 114 is fitted to the fitting hole 121 of the case-cover-side boss part 91 and the shaft-side joint part 111 is located in the fitting hole 121.

The fitting hole 121 has a cover-side joint part 128 (joint part) with which the shaft-side joint part 111 engages in a bottom part 127 of the hole. The cover-side joint part 128 is a substantially rectangular groove that passes through the center of the bottom part 127 having a substantially circular shape in plan view and extends along the upward-downward direction. Through fitting of the shaft-side joint part 111 to the cover-side joint part 128, the idle shaft 63 is connected to the case-cover-side boss part 91. The cover-side joint part 128 overlaps with the straight line L1 and extends along the upward-downward direction.

The spring 95 is so disposed as to be fitted to the outer circumference of the shaft-side joint part 111 in the fitting hole 121 and is compressed between the bottom part 127 and the end surface 114 of the idle shaft 63.

When the idle gear 62 is assembled to the crankcase 11, first a small assembly is formed by temporarily assembling, to the idle shaft 63, the bearings 92*a* and 92*b*, the idle gear 62, the sub-gear 99, the spring 100, the washer 101, the cover-side thrust bearing 94, the case-side thrust bearing 93, and the spring 95.

Subsequently, the small assembly is temporarily assembled to the crankcase-side boss part 90 in such a manner that the one end 63*b* of the idle shaft 63 is fitted to the shaft fitting part 108 of the crankcase-side boss part 90 and the one end 63*b* is made to abut against the step part 108*a*. Therefore, the idle shaft 63 abuts against the step part 108*a* and the position thereof is settled in the axial direction. In addition, the idler driven gear 97 and the sub-gear 99 mesh with the idler drive gear 61. The end surface 114 of the idle shaft 63 and the shaft-side joint part 111 protrude outward relative to the outer end of the shaft part 96. Moreover, the first-bank-side cam chain 64*f* is wound around the first-bank-side drive sprocket 98*f* and the second-bank-side cam chain 64*r* is wound around the second-bank-side drive sprocket 98*r*.

Next, the clutch cover 39 is fixed to the crankcase 11 from the outside by bolts (not shown) inserted into the plural fixing holes 39*a*. Specifically, in the assembling of the clutch cover 39, the other end 63*c* of the idle shaft 63 is fitted to the fitting hole 121 of the case-cover-side boss part 91 and the shaft-side joint part 111 is connected to the cover-side joint part 128. That is, the idle shaft 63 is supported through the fitting of the one end 63*b* and the other end 63*c* to the crankcase-side boss part 90 and the case-cover-side boss part 91. In addition, the idle shaft 63 is so fixed as to be incapable of rotating due to the connecting of the shaft-side joint part 111 to the cover-side joint part 128. Furthermore, the position of the idle shaft 63 is settled in the rotational direction due to the connecting of the shaft-side joint part 111 to the cover-side joint part 128. This allows the oil passage 113*a* to communicate with the inside notches 125.

Between the tip surface of the shaft-side joint part 111 and the bottom surface of the cover-side joint part 128, a gap S is set in the axial direction. The spring 95 is compressed between the bottom part 127 and the end surface 114 and biases the idle shaft 63 toward the crankcase-side boss part 90 so that the gap S can be ensured. As shown in FIG. 6, the idle shaft 63 receives a force in such a direction as to move toward the clutch cover 39 due to an oil flow F flowing from the oil passage 105 to the in-shaft oil passage 112.

In the present embodiment, the inner diameter of the in-shaft oil passage 112 is set smaller than that of the oil passage 105 to ensure the strength. Therefore, the idle shaft 63 is susceptible to the influence of the oil flow F on the side of the one end 63*b*. However, because being biased toward the crankcase-side boss part 90 by the spring 95, the idle shaft 63 can be prevented from moving to a large extent in the axial direction due to the oil flow F. Thus, even when there is variation in the oil flow F, the vibration of the idle shaft 63 in the axial direction can be prevented, so that generation of hammering noises can be prevented. Moreover, because the gap S is set between the tip surface of the shaft-side joint part 111 and the bottom surface of the cover-side joint part 128, the dimensional accuracy of the shaft-side joint part 111 and the cover-side joint part 128 in the axial direction does not need to be strictly managed and therefore the manufacturing is easy.

Furthermore, through the slight movement of the idle shaft 63 in the axial direction against the spring 95 due to the oil flow F, the gap between the crankcase-side boss part 90 and the idle shaft 63 becomes larger. This increases the amount of oil that passes through the gap and flows to the tip notches 107 and thus can effectively supply the oil to the case-side thrust bearing 93.

In the state in which the clutch cover 39 is attached, the outside abutting surface 122 of the case-cover-side boss part 91 abuts against the cover-side thrust bearing 94 and the inside abutting surface 123 abuts against the end surface of the bearing 92*a*. That is, the outside abutting surface 122 and the inside abutting surface 123 press the idle shaft 63 toward the crankcase-side boss part 90 through the cover-side thrust bearing 94 and the bearing 92*a*. By this pressing force, the case-side thrust bearing 93 is clamped between the first abutting surface 106 and the idle gear 62.

The idle gear 62 is supported by the case-side thrust bearing 93 and the cover-side thrust bearing 94 in the axial direction and is supported by the bearings 92*a* and 92*b* in the radial direction, and rotates around the idle shaft 63.

The washer 101 is pressed against the sub-gear 99 by the cover-side thrust bearing 94.

The oil supplied from the oil passage 105 to the side of the idle shaft 63 flows as shown by arrows in FIG. 6. Specifically, part of the oil supplied from the oil passage 105 to the in-shaft oil passage 112 passes through the oil passages 113*b* and 113*c* and is supplied to the bearings 92*a* and 92*b*. Furthermore, part of the oil in the in-shaft oil passage 112 passes from the oil passage 113*a* and through the inside notches 125 to flow into the oil reservoir 124. The oil in the oil reservoir 124 is supplied to the bearings 92*a* and 92*b*, the cover-side thrust bearing 94, and the idler driven gear 97. In addition, the oil passes through the outside notches 126 and is discharged to the space outside the case-cover-side boss part 91 to drop down and return to the oil pan 40. Specifically, the oil in the oil reservoir 124 flows into the bearing 92*a* from a gap on the side of the end surface of the bearing 92*a* in the axial direction.

As shown in FIG. 11, in the case-cover-side boss part 91, the outside notches 126 are made at the left and right side parts of the outside abutting surface 122. Thus, a large amount of oil can be accumulated in the oil reservoir 124. Furthermore, the inside notches 125 of the inside abutting surface 123 are made at different positions in the circumferential direction from the outside notches 126 in such a manner that the straight line L1 is substantially orthogonal to the straight line L2. Therefore, oil supplied from the inside notches 125 to the oil reservoir 124 can be prevented from being immediately discharged from the outside notches 126 and the oil can be retained in the oil reservoir 124 evenly. Thus, the oil can be properly fed to oil feed points.

As described above, according to the embodiment to which the present invention is applied, the valve train system drive device 60 is provided in the engine 1 having the crankshaft 10 provided in the crankcase 11 and the valve train mechanisms 45*f* and 45*r*, and has the idle gear 62 that transmits power received from the crankshaft 10 to the valve train mechanisms 45*f* and 45*r*, the idle shaft 63 that is provided in parallel to the crankshaft 10 and rotatably supports the idle gear 62, and the clutch cover 39 that covers the crankcase 11 from a lateral side. The crankcase-side boss part 90 that is formed on the sidewall 20*b* of the crankcase 11 and supports the one end 63*b* of the idle shaft 63 and the case-cover-side boss part 91 that is formed inside the clutch cover 39 and supports the other end 63*c* of the idle shaft 63 are provided. The cover-side joint part 128 and the shaft-side joint part 111 that engage with each other are formed at the case-cover-side boss part 91 and the other end 63*c* of the idle shaft 63, and engagement of the cover-side joint part 128 and the shaft-side joint part 111 with each other precludes the idle shaft 63 from rotating. By this configuration, the one end 63*b* and the other end 63*c* of the idle shaft 63 are supported by the crankcase-side boss part 90 formed on the sidewall 20*b* of the crankcase 11 and the case-cover-side boss part 91 formed on the clutch cover 39. In addition, the idle shaft 63 can be made incapable of rotating by the shaft-side joint part 111 and the cover-side joint part 128 on the side of the other end 63*c*. Thus, the structure to support the idle shaft 63 can be simplified. This allows size reduction, weight reduction, and simplification of the engine 1.

The idle gear 62 is rotatably supported by the idle shaft 63 with the intermediary of the bearings 92*a* and 92*b*, and the in-shaft oil passage 112 is formed in the idle shaft 63, and the in-shaft oil passage 112 is connected to the case-side oil passage 58 formed in the sidewall 20*b* of the crankcase 11 at the one end 63*b* of the idle shaft 63. Furthermore, the case-cover-side boss part 91 has the inside abutting surface 123 that abuts against the bearings 92*a* and 92*b* in the axial direction and the oil reservoir 124 having a concave shape is provided at the outer periphery of the inside abutting surface 123. Thus, oil can be supplied to the bearings 92*a* and 92*b* from the oil reservoir 124 on the outer peripheral side of the inside abutting surface 123 of the case-cover-side boss part 91 and therefore the bearings 92*a* and 92*b* can be fed with oil by a simple structure.

The inside notches 125 to allow the inside abutting surface 123 to communicate with the oil reservoir 124 are made in the inside abutting surface 123 and the oil passage 113*a* in the idle shaft 63 communicates with the oil reservoir 124 due to the inside notches 125. Therefore, the oil in the oil reservoir 124 can be sufficiently supplied to the bearings 92*a*, 92*a* via the inside notches 125.

The outside abutting surface 122 is provided at the outer periphery of the oil reservoir 124 and the outside abutting surface 122 protrudes in the axial direction relative to the inside abutting surface 123. Therefore, the capacity of the oil reservoir 124 can be set large, which allows effective oil feed to the bearings 92*a* and 92*b*.

The cover-side thrust bearing 94 is interposed between the outside abutting surface 122 and the idle gear 62. Thus, the cover-side thrust bearing 94 can be fed with oil from the oil reservoir 124.

The outside notches 126 to allow the oil reservoir 124 to communicate with a space outside the case-cover-side boss part 91 are made in the outside abutting surface 122. Therefore, when excess oil is supplied to the oil reservoir 124, the oil can be discharged from the outside notches 126 to the space outside the case-cover-side boss part 91.

The inside notches 125 and the outside notches 126 are made at positions different from each other on the case-cover-side boss part 91. Thus, oil can be evenly supplied to the oil reservoir 124 and the capacity of the oil reservoir 124 can be efficiently used.

The inside notches 125 are made as a pair of notches with placement in which the inside notches 125 are opposed to each other in the radial direction on the annular inside abutting surface 123, and the outside notches 126 are made as a pair of notches with placement in which the outside notches 126 are opposed to each other on the annular outside abutting surface 122. Furthermore, the straight line L1 linking the pair of inside notches 125 is substantially orthogonal to the straight line L2 linking the pair of outside notches 126. Thus, oil can be evenly supplied to the oil reservoir 124 and the capacity of the oil reservoir 124 can be efficiently used.

The in-shaft oil passage 112 is formed in the idle shaft 63, and the in-shaft oil passage 112 is connected to the case-side oil passage 58 formed in the sidewall 20*b* of the crankcase 11 at the one end 63*b* of the idle shaft 63, and the spring 95 is interposed between the other end 63*c* of the idle shaft 63 and the case-cover-side boss part 91. Therefore, even when variation is caused in the oil pressure of oil passing through the in-shaft oil passage 112 in the idle shaft 63, the idle shaft 63 can be supported in the axial direction by the spring 95 and generation of sounds attributed to the vibration of the idle shaft 63 can be prevented.

In the above embodiment, it is explained that the straight line L1 linking the pair of inside notches 125 is substantially orthogonal to the straight line L2 linking the pair of outside notches 126. However, the invention of the present application is not limited thereto and the positions of the notches may be changed. A description will be made below about this case as a modification example. In this modification example, parts formed in the same manner as the above embodiment are given the same symbols and description thereof is omitted.

MODIFICATION EXAMPLE

Figure 12:
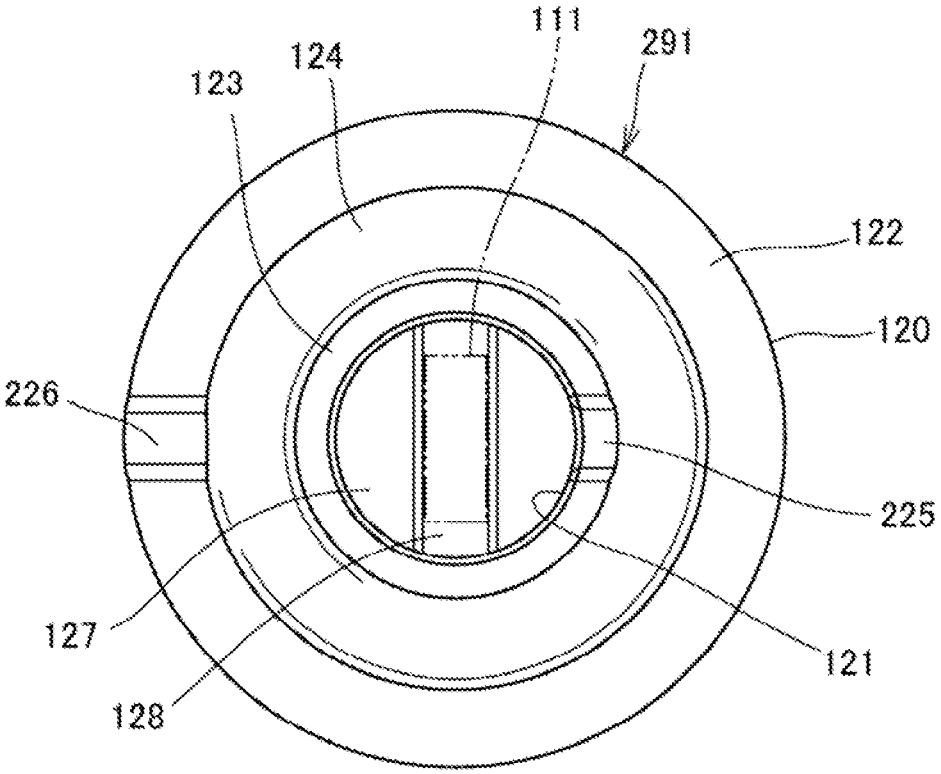
FIG. 12 is a plan view of a case-cover-side boss part, in a modified example according to a second embodiment of the invention.

FIG. 12 is a plan view of a case-cover-side boss part 291 in the modification example according to a second embodiment of the invention.

The case-cover-side boss part 291 has the cylindrical part 120, the fitting hole 121, the outside abutting surface 122, the inside abutting surface 123, the oil reservoir 124, the bottom part 127, and the cover-side joint part 128.

The inside abutting surface 123 has an inside notch 225 to allow the inside abutting surface 123 to communicate with the oil reservoir 124. The oil reservoir 124 communicates with the oil passage 113*a* via the inside notch 225. The inside notch 225 is at a side part of the inside abutting surface 123 as viewed in the axial direction.

The outside abutting surface 122 has an outside notch 226 (second notch) to allow the oil reservoir 124 to communicate with a space outside the case-cover-side boss part 291. The outside notch 226 is made at a side part of the outside abutting surface 122 at a position different from that of the inside notch 225 by substantially 180 degrees in the circumferential direction as viewed in the axial direction.

In the case-cover-side boss part 291, the outside notch 226 is made at a side part of the outside abutting surface 122 in the left-right direction and thus a large number of oil can be accumulated in the oil reservoir 124. Furthermore, the inside notch 225 of the inside abutting surface 123 is made at a position that is different from that of the outside notch 226 by substantially 180 degrees in the circumferential direction and is distant from the outside notch 226. Therefore, oil supplied from the inside notch 225 to the oil reservoir 124 can be prevented from being immediately discharged from the outside notch 226. Thus, the oil can be retained in the oil reservoir 124 evenly and the oil can be properly fed to oil feed points.

The above embodiment is what shows one aspect to which the present invention is applied and the present invention is not limited to the above embodiment.

In the above embodiment, the description is made by taking as an example the spring 95 having a coil shape as the elastic spring member that biases the idle shaft 63 in the axial direction. However, the configuration is not limited thereto and the idle shaft 63 may be biased in the axial direction by an elastic spring member such as rubber for example.

Furthermore, in the above embodiment, it is explained that a small assembly is formed in assembling the idle gear 62 to the crankcase 11. However, the configuration is not limited thereto and the respective parts may be individually assembled.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

DESCRIPTION OF REFERENCE SYMBOLS

1 Engine
10 Crankshaft
11 Crankcase
20*b* Sidewall (wall of crankcase)
39 Clutch cover (case cover)
45*f*, 45*r* Valve train mechanism (valve train system)
58 Case-side oil passage (oil passage formed in wall of crankcase)
60 Valve train system drive device
62 Idle gear
63 Idle shaft
63*b* One end
63*c* The other end
90 Crankcase-side boss part
91, 291 Case-cover-side boss part
92*a*, 92*b* Bearing (bearing member)
94 Cover-side thrust bearing (thrust bearing)
95 Spring (elastic spring member)
111 Shaft-side joint part (joint part)
112 In-shaft oil passage (oil passage)
122 Outside abutting surface (second abutting surface)
123 Inside abutting surface (abutting surface)
124 Oil reservoir
125, 225 Inside notch (notch)
126, 226 Outside notch (second notch)
128 Cover-side joint part (joint part)
L1 Straight line (straight line linking a pair of notches)
L2 Straight line (straight line linking a pair of second notches)

What is claimed is:

1. In an engine having a crankcase and a crankshaft provided in the crankcase, and having a valve train system and an idle gear that transmits power from the crankshaft to the valve train system, the engine further having an idle shaft that is provided in parallel to the crankshaft and which rotatably supports the idle gear thereon, and a case cover that covers a portion of the crankcase, the improvement comprising a valve train system drive device comprising:

a crankcase-side boss part formed on a wall of the crankcase for supporting a first end of the idle shaft;

a case-cover-side boss part formed inside the case cover for supporting a second end of the idle shaft;

wherein joint parts, that are configured to selectively engage with each other, are formed at the case-cover-side boss part and at the second end of the idle shaft, respectively, and wherein engagement of the joint parts with each other precludes the idle shaft from rotating.

2. The engine according to claim 1, wherein:

the idle gear is rotatably supported by the idle shaft with bearing members therebetween, and an oil passage is formed in the idle shaft, said oil passage fluidly connected to an oil supply passage formed in the wall of the crankcase at the first end of the idle shaft, and the case-cover-side boss part comprises a first abutting surface that abuts against one of the bearing members in axial direction, and a concave oil reservoir is provided at an outer periphery of the first abutting surface.

3. The engine according to claim 2, wherein a first notch is formed in the first abutting surface to allow the first abutting surface to communicate with the oil reservoir, and wherein the oil passage in the idle shaft communicates with the oil reservoir via the first notch.

4. The engine according to claim 2, wherein the case-cover-side boss part comprises a second abutting surface at an outer periphery of the oil reservoir, the second abutting surface protruding in an axial direction relative to the first abutting surface.

5. The engine according to claim 4, further comprising a thrust bearing interposed between the second abutting surface and the idle gear.

6. The engine according to claim 4, wherein a second notch is formed in the second abutting surface to allow the oil reservoir to communicate with a space outside the case-cover-side boss part.

7. The engine according to claim 6, wherein a first notch is formed in the first abutting surface to allow the first abutting surface to communicate with the oil reservoir, and wherein the first notch and the second notch are made at positions different from each other in a circumferential direction of the case-cover-side boss part.

8. The engine according to claim 7, wherein:

each of the first and second notches, respectively, is one of a pair of notches, the first notches are opposed to each other in a radial direction on the first abutting surface having a ring shape, the second notches are opposed to each other in a radial direction on the second abutting surface having a ring shape, and a straight line linking the pair of first notches is substantially orthogonal to a straight line linking the pair of second notches.

9. The engine according to claim 1, wherein:

an oil passage is formed in the idle shaft, said oil passage is connected to an oil supply passage formed in the wall of the crankcase at the first end of the idle shaft, and said drive device further comprises an elastic spring member interposed between the second end of the idle shaft and the case-cover-side boss part.

10. The engine according to claim 3, wherein the case-cover-side boss part comprises a second abutting surface at an outer periphery of the oil reservoir, the second abutting surface protruding in an axial direction relative to the first abutting surface.

11. The engine according to claim 10, wherein a second notch is formed in the second abutting surface to allow the oil reservoir to communicate with a space outside the case-cover-side boss part.

12. The engine according to claim 11, wherein said drive device further comprises an elastic spring member interposed between the second end of the idle shaft and the case-cover-side boss part.

13. An internal combustion engine comprising:

a hollow crankcase having a wall with a crankcase-side boss part formed thereon for supporting a first end of an idle shaft, a crankshaft provided in the crankcase;

a valve train system comprising a pair of cylinder heads and at least one camshaft rotatably disposed in each cylinder head;

a case cover that covers a portion of the crankcase, the case cover having a case-cover-side boss part formed on a wall thereof for supporting a second end of an idle shaft; and a valve train system drive device comprising:

an idle gear that transmits power from the crankshaft to the valve train system;

an idle shaft that is provided in parallel to the crankshaft and which rotatably supports the idle gear thereon, the idle shaft extending between the crankcase-side boss part of the crankcase and the case-cover-side boss part of the case cover;

a pair of timing gears, wherein each of said camshafts has one of said timing gears affixed thereto for concurrent rotation therewith; and a pair of endless loop drive members, with each of said timing gears respectively connected to the idle gear by one of said drive members;

wherein joint parts, that are configured to selectively engage with each other, are formed at the case-cover-side boss part and at the second end of the idle shaft, respectively, and wherein engagement of the joint parts with each other precludes the idle shaft from rotating.

14. The engine according to claim 13, wherein:

the idle gear is rotatably supported by the idle shaft with bearing members therebetween, and an oil passage is formed in the idle shaft, said oil passage fluidly connected to an oil supply passage formed in the wall of the crankcase at the first end of the idle shaft, and the case-cover-side boss part comprises a first abutting surface that abuts against one of the bearing members in axial direction, and a concave oil reservoir is provided at an outer periphery of the first abutting surface.

15. The engine according to claim 14, wherein a first notch is formed in the first abutting surface to allow the first abutting surface to communicate with the oil reservoir, and wherein the oil passage in the idle shaft communicates with the oil reservoir via the first notch.

16. The engine according to claim 15, wherein the case-cover-side boss part comprises a second abutting surface at an outer periphery of the oil reservoir, the second abutting surface protruding in an axial direction relative to the first abutting surface.

17. The engine according to claim 16, wherein a second notch is formed in the second abutting surface to allow the oil reservoir to communicate with a space outside the case-cover-side boss part.

18. The engine according to claim 17, wherein the first notch and the second notch are made at positions different from each other in a circumferential direction of the case-cover-side boss part.

19. The engine according to claim 17, wherein:

each of the first and second notches, respectively, is one of a pair of notches, the first notches are opposed to each other in a radial direction on the first abutting surface having a ring shape, the second notches are opposed to each other in a radial direction on the second abutting surface having a ring shape, and a straight line linking the pair of first notches is substantially orthogonal to a straight line linking the pair of second notches.

20. The engine according to claim 19, wherein said drive device further comprises an elastic spring member interposed between the second end of the idle shaft and the case-cover-side boss part.

* * * * *